US005490465A

United States Patent [19]

Hoyt et al.

[11] Patent Number: 5,490,465

[45] Date of Patent: Feb. 13, 1996

[54] PAPERBOARD/CORRUGATED BOARD PALLETS AND METHODS FOR MANUFACTURING SUCH PALLETS

[75] Inventors: Craig R. Hoyt, Columbus; Edwin D. Wells, Cable, both of Ohio

[73] Assignee: Buckeye Boxes, Inc., Columbus, Ohio

[21] Appl. No.: 173,220

[22] Filed: Dec. 27, 1993

[51] Int. Cl.[6] ..... B65D 19/00

[52] U.S. Cl. ..... 108/51.3

[58] Field of Search ..... 108/51.3, 51.1, 108/56.1, 56.3

[56] References Cited

U.S. PATENT DOCUMENTS

| | | | |
|---|---|---|---|
| 2,444,183 | 6/1948 | Cahners . | |
| 2,716,532 | 8/1955 | Wysong, Jr. et al. . | |
| 2,728,545 | 12/1955 | Hermitage . | |
| 2,744,713 | 5/1956 | De Villers . | |
| 3,004,742 | 10/1961 | Davidson . | |
| 3,012,747 | 12/1961 | Greene . | |
| 3,099,969 | 8/1963 | Davidson . | |
| 3,131,656 | 5/1964 | Houle . | |
| 3,434,435 | 3/1969 | Achermann et al. . | |
| 3,519,190 | 7/1970 | Achermann et al. . | |
| 3,683,822 | 8/1972 | Roberts et al. . | |
| 3,940,101 | 2/1976 | Heidelbach . | |
| 3,982,057 | 9/1976 | Briggs et al. | 108/51.3 X |
| 4,792,325 | 12/1988 | Schmidtke . | |
| 4,802,421 | 2/1989 | Atterby et al. . | |
| 4,834,001 | 5/1989 | Atterby et al. . | |
| 4,867,074 | 9/1989 | Quasnick . | |
| 5,001,991 | 3/1991 | Smith | 108/51.3 |
| 5,184,558 | 2/1993 | Wozniacki | 108/51.3 |
| 5,365,857 | 11/1994 | Kilpatrick et al. | 108/51.3 |
| 5,367,960 | 11/1994 | Schleicher | 108/56.1 X |
| 5,402,735 | 4/1995 | DeJean | 108/56.1 X |

*Primary Examiner*—Jose V. Chen

*Attorney, Agent, or Firm*—Frank H. Foster; Kremblas, Foster & Millard

[57] ABSTRACT

A paperboard pallet having generally U-shaped, parallel runners with notches along the distal edges of their legs for receiving stringers. The runner legs diverge from the central web and are formed by a plurality of nested paperboard laminations, each having a central web and distal legs. The central webs are defined by spaced parallel scores spaced progressively more closely toward the interior. The stringers each comprise a multi-layered coil of paperboard sheet wound into a tube of triangular cross-section. The sides of the triangle are defined by scores to form fold lines, the scores of the more interior layers being more closely spaced than the scores of the more exterior layers. After scoring, the sheet is wound and bonded. A generally U-shaped saddle cap has a central web which extends between the opposite distal edges of the runner legs and has opposite legs which are bonded to the legs of the runner. A plurality of notches along the distal edges of the saddle caps have a width substantially equal to the width of the stringers and are spaced to register with the stringers.

14 Claims, 5 Drawing Sheets

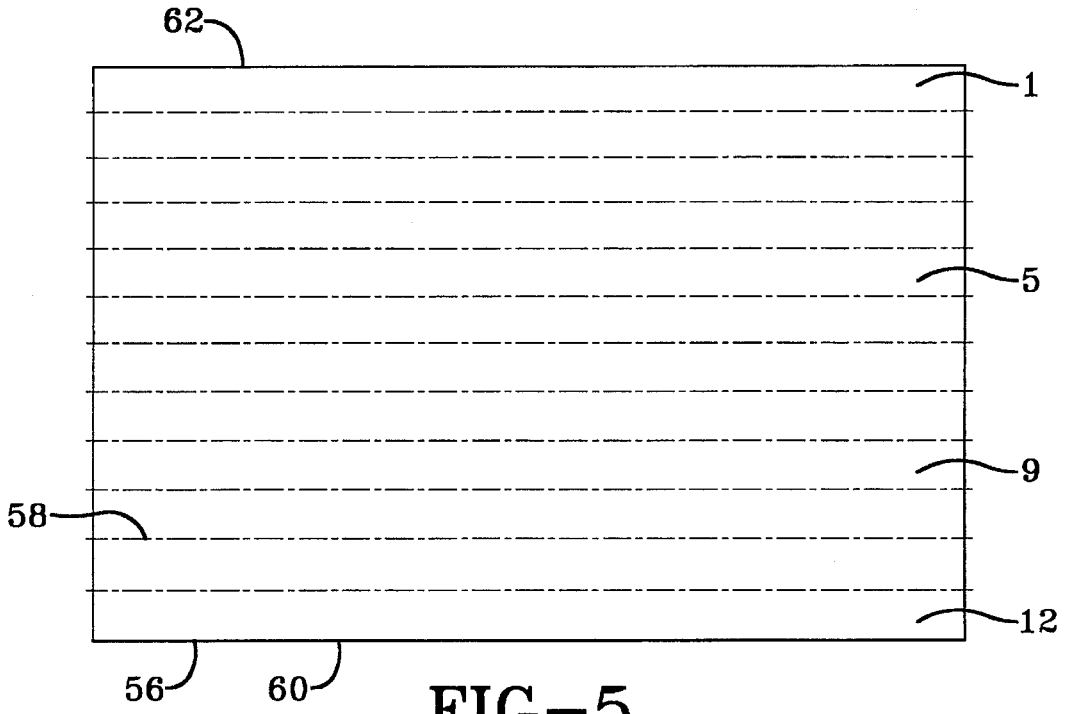
FIG-5
FIG-6
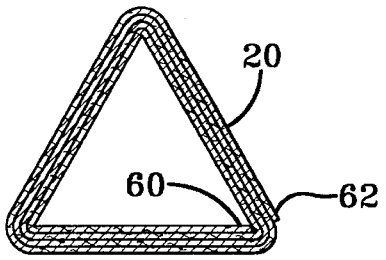
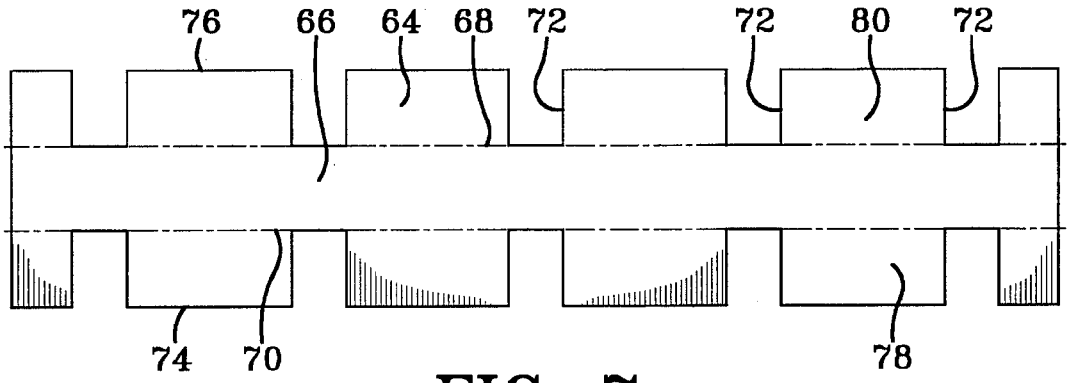
FIG-7

PAPERBOARD/CORRUGATED BOARD PALLETS AND METHODS FOR MANUFACTURING SUCH PALLETS

TECHNICAL FIELD

This invention relates generally to the structure of, and methods for manufacturing, pallets from recyclable materials, such as paperboard, corrugated board, or other similar fiberboard materials, and more particularly relates to such a pallet exhibiting improved strength and ease and reduced cost of manufacturing.

BACKGROUND ART

Pallets have long been used to support goods because they provide a single, movable platform upon which goods can be supported and moved, they permit air circulation beneath the goods, and, most importantly, they support the goods in a raised position to permit the insertion of a fork lift beneath the goods. Although pallets have been made from a variety of materials, pallets are most commonly made from wooden boards which are nailed together. Wooden pallets, however, are difficult to dispose of in an environmentally responsible manner. Wood is a strong, hard material, the components of a wooden pallet are difficult to separate and the nails in the pallets require separation from the wooden components.

The prior art has recognized the desirability of forming pallets of recyclable material, such as fiberboard, paperboard, and corrugated board. Such materials are not only considerably more easily broken down into recyclable materials, but these recyclable materials can be utilized for manufacturing new fiberboard, paperboard, and corrugated board for manufacture into new pallets.

A principal problem which has been experienced in fabricating pallets of these materials results from the inherent weakness of the initial, relatively thin materials such as paperboard and kraft paper. These materials must be formed into structures providing sufficient strength to function as pallets. Therefore, much attention has been given to forming these fibrous sheet materials into structures which have suitable shapes and sizes to provide sufficient strength, while allowing the economical and efficient use of the raw materials. Interrelated to the strength of the structures themselves is the need to provide a method for fabricating and assembling pallets from fibrous materials in a manner which simultaneously produces a sufficiently strong and rigid pallet, while minimizing production costs.

Patents showing pallets constructed of such fiber based materials include U.S. Pat. Nos. 4,867,074; 4,802,421; and 4,792,325.

However, the pallets disclosed in these patents, together with pallets and related subject matter disclosed in patents cited in the information disclosure statement filed in connection with this patent, suffer from various disadvantages with respect to strength and/or ease of fabrication. For example, several require the insertion of a tubular component into a mating hole in another component, which is a more difficult fabrication step than merely laying one component atop another. Others exhibit insufficient strength.

It is therefore an object and feature of the present invention to provide a pallet constructed of fiber based board materials showing both improved strength and improved ease of manufacture.

BRIEF DESCRIPTION OF INVENTION

A pallet embodying the present invention has a plurality of runners, typically three, upon which a plurality of stringers, typically five, are transversely supported to extend between the runners. The runners have generally U-shaped saddle caps extending across the tops of the runners and the stringers with the saddle cap legs extending downwardly and bonded to the sides of the runners. Each runner comprises a plurality of nested paperboard laminations bonded together to form a U-shaped channel. The channel has a central web and legs extending from that central web with the laminations being defined by spaced scores which are progressively more closely spaced on the laminations toward the interior of the runner. Each runner has a plurality of stringer-receiving notches spaced along and formed into the opposite legs of the runner. The stringers are matingly received and attached in those notches and extend transversely between the runners. The stringers are preferably formed of a multi-layered coil of paperboard sheet, wound into a tube of triangular cross-section. The legs of the triangular cross-section are defined by spaced, generally parallel scores formed in the paperboard sheet. The scores of the more interior layers are more closely spaced than the scores of the more exterior layers, and the interfacing legs of the triangular cross-section are bonded together. The U-shaped saddle caps are preferably formed with a plurality of notches along the opposite distal edges of the saddle cap legs and have a width substantially equal to the width of the stringers and are spaced to register with the stringers when bonded to the top and sides of the runner and preferably also to the interfacing surface of the top of the stringers.

BRIEF DESCRIPTION OF DRAWINGS

FIG. 5 is a plan view of a paperboard sheet scored for being formed into a stringer in accordance with the present invention.

FIG. 6 is a view in section of an equilateral, triangularly shaped stringer formed in accordance with the present invention.

FIG. 7 is a plan view of a corrugated board sheet notched and scored to form a saddle cap in accordance with the present invention.

Figure 1:
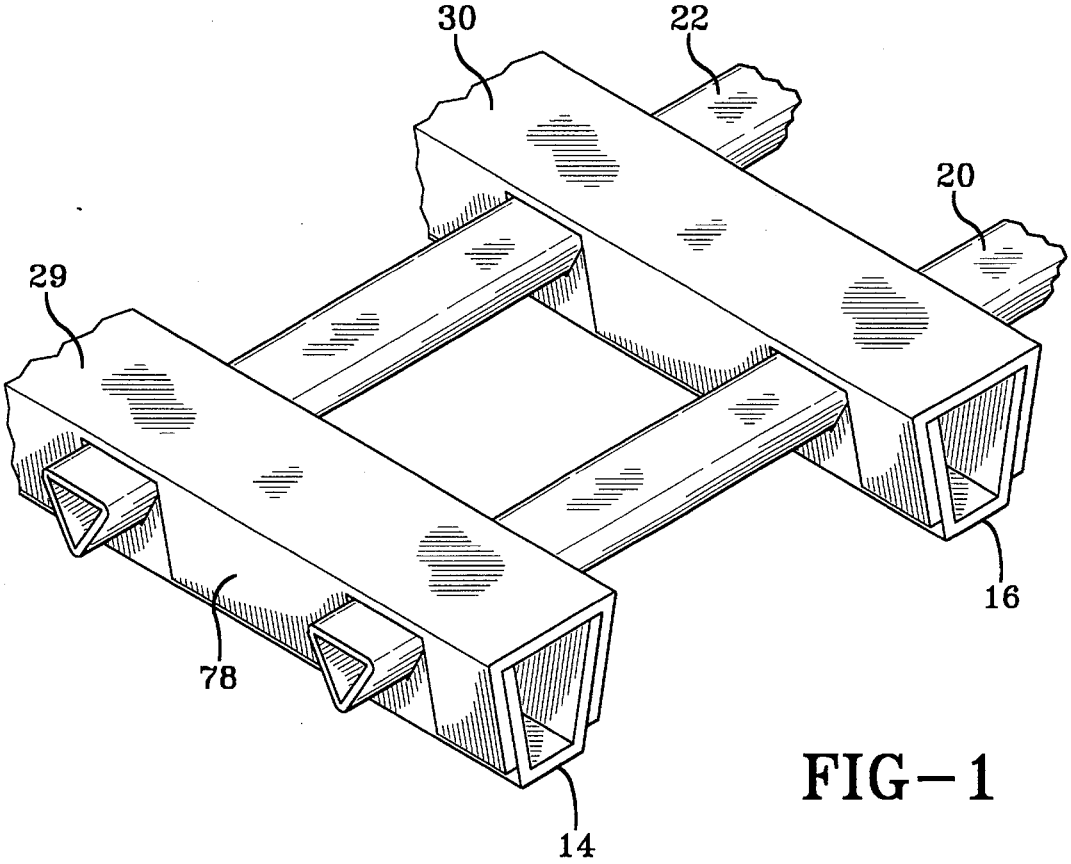
FIG. 1 is a view in perspective of a portion of a pallet embodying the present invention and illustrating the assembled relationship of the component parts.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Figure 8:
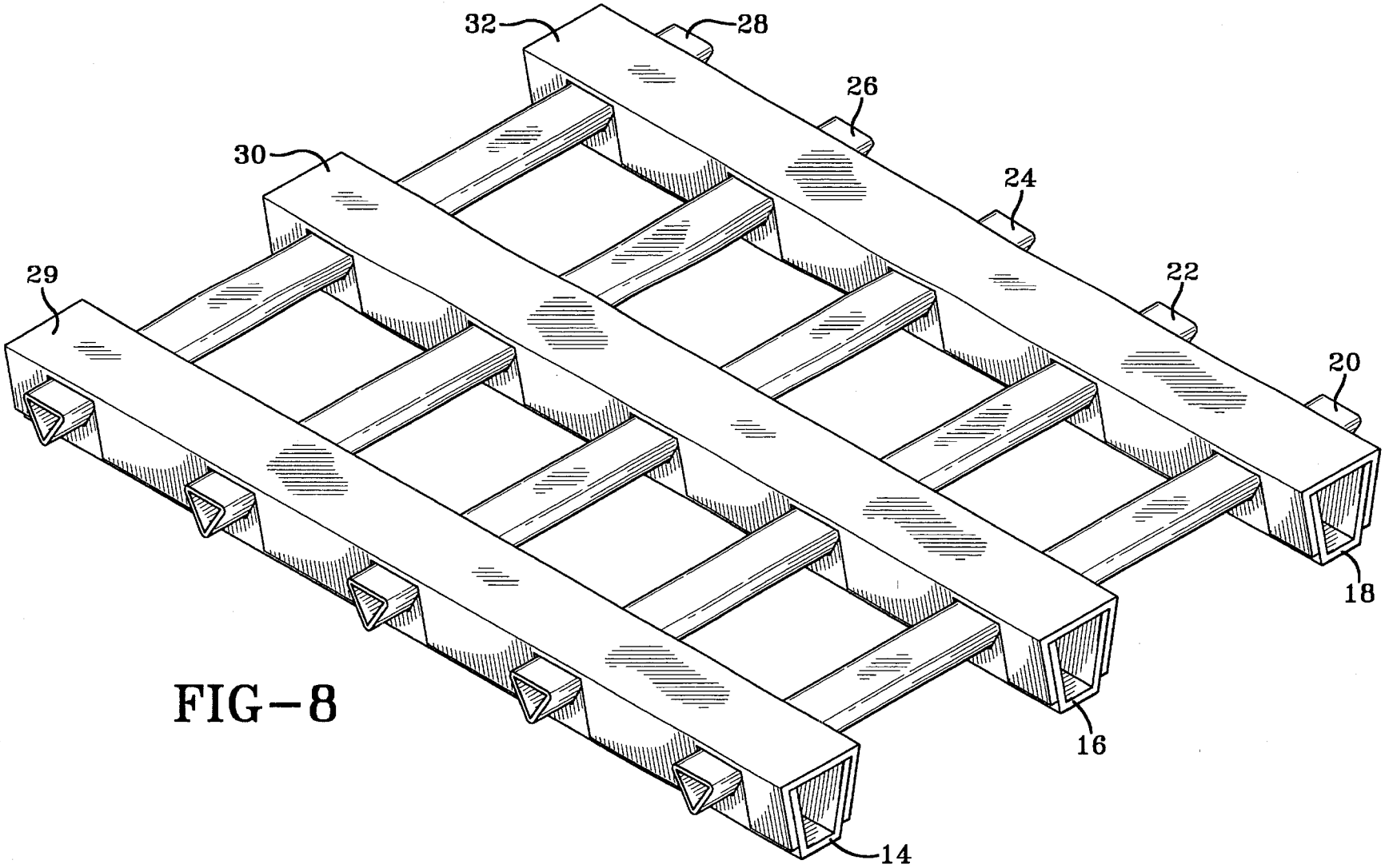
FIG. 8 is a view in perspective of an entire pallet embodying the present invention.

FIGS. 1 and 8 illustrate a portion of a pallet constructed and assembled in accordance with the present invention. The pallet has three generally parallel paperboard runners 14, 16, and 18 supporting five, generally parallel, spaced paperboard stringers 20, 22, 24, 26, and 28, which are supported upon and extend transversely across the runners 14, 16, and 18. Three generally U-shaped saddle caps 29, 30 and 32 are bonded across the top of the runners and stringers and have distal, opposite side legs which are folded down upon and bonded to the side legs of the runners 14, 16, and 18.

Figure 2:
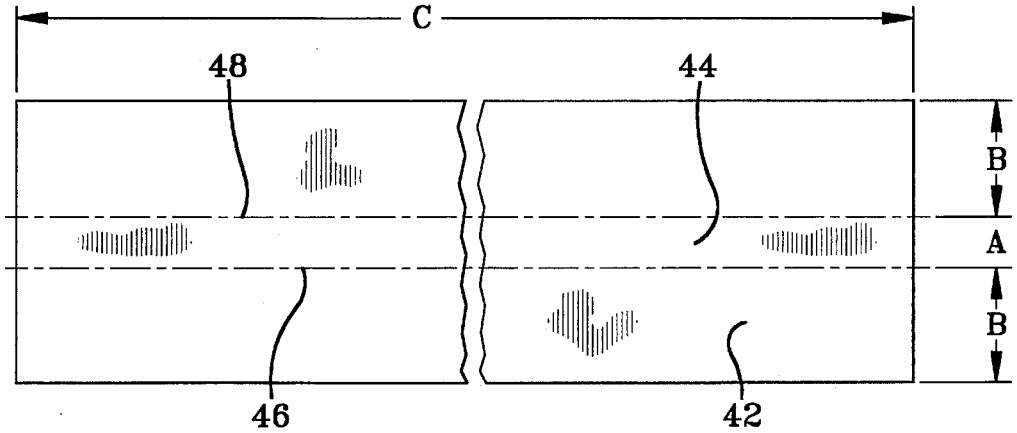
FIG. 2 is a plan view of a paperboard sheet scored to form a lamination of a runner constructed in accordance with the present invention and, together with Table 1, illustrating preferred dimensions.
Figures 3, 4:
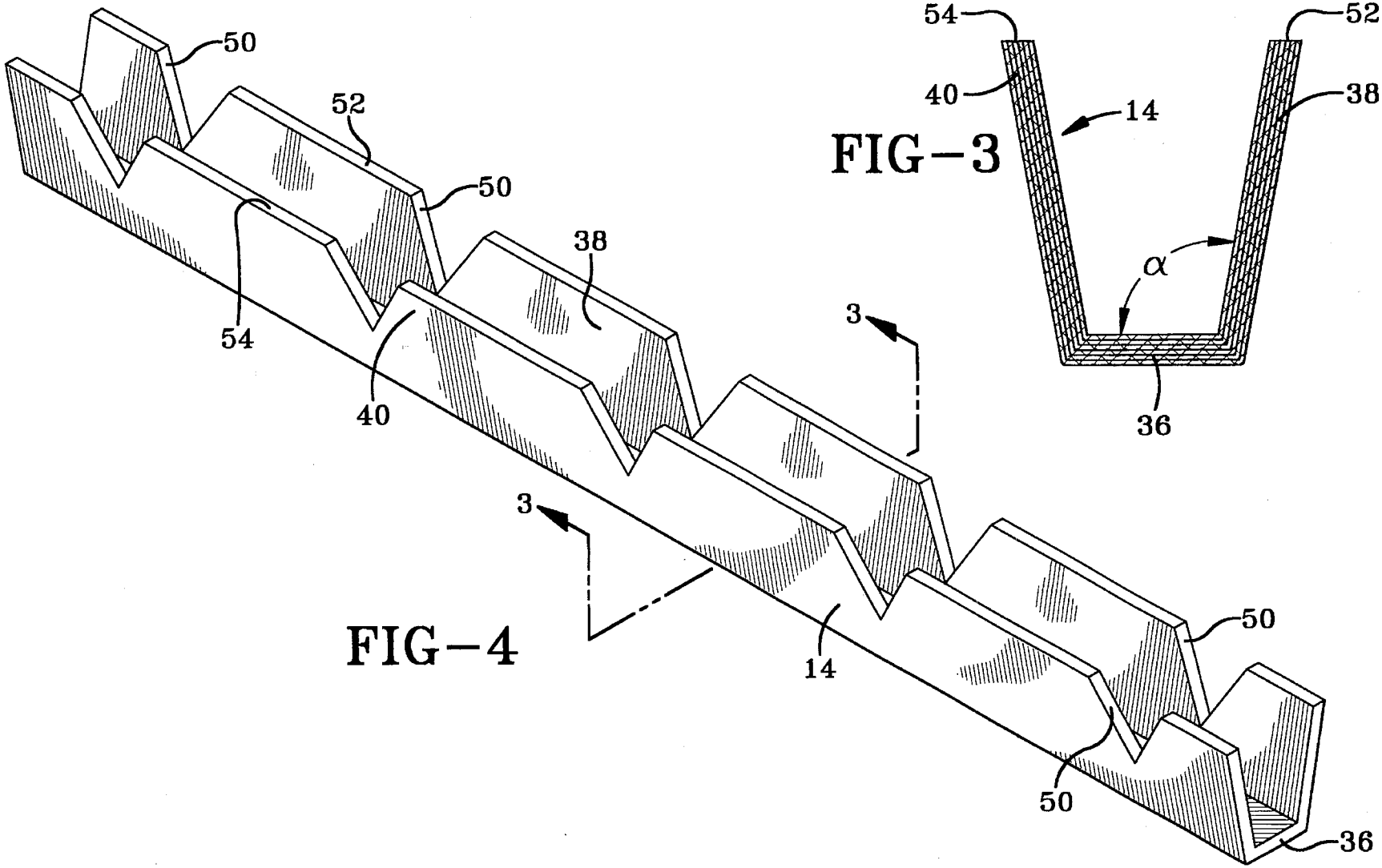
FIG. 3 is a view in section of a runner embodying the present invention taken substantially along the line 3—3 of FIG. 4.
FIG. 4 is a view in perspective of an entire runner embodying the present invention.

FIGS. 2, 3 and 4 illustrate the structure of runners constructed in accordance with the present invention. As seen in FIG. 3, each runner comprises a plurality of nested paperboard laminations which are bonded together to form a U-shaped channel having a central web 36 and side legs 38 and 40 which extend from the central web 36. Each lamination is formed from a sheet, such as sheet 42 illustrated in FIG. 2, of paperboard, such as 32 point chipboard. Preferably there are six or seven layers of paperboard depending upon the pallet strength requirements and the paperboard thickness and strength. The central web of each lamination, such as central web 44 in FIG. 2, is defined by spaced scores 46 and 48 which form fold lines for folding each lamination into the U-shape apparent in FIG. 3 for nesting and bonding together. The spaced scores are progressively more closely spaced on the laminations which are positioned more toward the interior of the runner and the opposite legs of each lamination are progressively shorter in sequence with the progressively more closely spaced web-defining scores. Thus, each lamination has a progressively narrower central web and shorter side leg as one progresses from the exterior-most lamination to the interior-most lamination.

Preferably, the legs 38 and 40 of each runner diverge from the central web 36 at an obtuse angle $\alpha$ with the central web 36. In the preferred embodiment the angle $\alpha$ is approximately 100°. Testing of experimental pallets has shown that the use of diverging legs in embodiments of Applicant's invention improves the load capacity from approximately 9,000 pounds to approximately 18,000 pounds.

The preferred dimensions for the runners of a typical pallet are illustrated in Table 1 for the central web dimension A, side leg dimension B, and length C, shown in FIG. 2. These are for a 1/16 inch thick material. Preferably the progression in decreased width is approximately equal to the thickness of the sheet material being used.

TABLE 1

| | Runners | | |
|---|---|---|---|
| | Dimension in inches | | |
| Lamination Number | A | B | C |
| 1 (innermost) | 1 10/16 | 3 12/16 | 48" |
| 2 | 1 11/16 | 3 13/16 | " |
| 3 | 1 12/16 | 3 14/16 | " |
| 4 | 1 13/16 | 3 15/16 | " |
| 5 | 1 14/16 | 4 | " |
| 6 (outermost) | 1 15/16 | 4 1/16 | " |

Although the laminations illustrated in FIG. 2 can first be cut to the dimensions of FIG. 2 and Table 1, preferably they are formed from a material of uniform width which is first scored and then folded along the scores into a U-shape. An adhesive is then applied to a surface, the laminations are nested together and retained in the desired divergent shape until the adhesive sets. The ends of the legs 38 and 40 are then trimmed off evenly, as illustrated, to the dimensions of Table 1. The runner can be formed in a batch process in which event the laminations may be cut to length before applying the adhesive. Alternatively, a continuous process can feed material in parallel from six or seven reels of stock material and the runner may be cut to length after the adhesive sets.

Forming the central webs and opposite legs of the laminations of a progressively narrower width improves the closeness of the bonded laminations at the folds. The divergent orientation of the legs at an obtuse angle with the central web provides considerably more strength and resistance to distortion from lateral forces acting parallel to the direction of the stringers and therefore provides more lateral stability. More importantly, this structural feature increases the maximum force which the pallet can withstand without being significantly crushed.

After the runners are assembled, the adhesive has set, and they are cut or trimmed, a plurality of triangularly shaped, stringer receiving notches 50 are formed into the opposite distal edges 52 and 54 of the legs 38 and 40 of the runner, such as runner 14. The notches may be cut individually or three runners may be held in parallel, side by side relation and the notches cut simultaneously in all three. The notches 50 formed in the edges 52 and 54 of the runners are formed to have a shape and size to matingly fit against two of the three sides of the equilateral, triangular cross-section stringers so that an adhesive, such as a hot melt adhesive, can be laid upon the notches and the stringers can be seated and adhered in those notches.

FIGS. 5 and 6 illustrate the construction of the stringers, such as stringer 20. Each stringer is constructed from a paperboard sheet, such as paperboard sheet 56 illustrated in FIG. 5. Each side or leg of the triangularly cross-sectioned stringer is defined by spaced, generally parallel scores 58 formed across the sheet 56. The scores near the first side 60 of the stringer sheet 56 are more closely spaced than the scores near the opposite second side 62. An adhesive is applied to the sheet 56 and the sheet is then wound into a tube of triangular cross-section, beginning with the first side 60 so that the first side 60 is on the interior of the stringer 20, while the second side 62 is on the exterior.

Preferably the spacing of the scores becomes progressively wider as one progresses from the first side to the second side 62. Most preferably, there are contiguous pairs of equally wide segments, followed by a progressively smaller equally sized pair of contiguous, equally sized segments. Table 2 illustrates the preferred sequence of score spacing in the preferred embodiment of the invention.

TABLE 2

| | Stringers | |
|---|---|---|
| Web Number | Web Width | Web Length |
| 1 (innermost) | 2" | 40" |
| 2 | 2" | " |
| 3 | 2 1/16" | " |
| 4 | 2 1/16" | " |

TABLE 2-continued

| | Stringers | |
|---|---|---|
| Web Number | Web Width | Web Length |
| 5 | 2⅛" | " |
| 6 | 2⅛" | " |
| 7 | 2³⁄₁₆" | " |
| 8 | 2³⁄₁₆" | " |
| 9 | 2¼" | " |
| 10 | 2¼" | " |
| 11 | 2⁵⁄₁₆" | " |
| 12 (outermost) | 2⁵⁄₁₆" | " |

After the sheet 56 is coated with an adhesive, it is wound into the triangular shape illustrated in FIG. 6. The progressively narrower spacing between the scores, which form fold lines, provides a tighter fit, with sharper corners. These sharper corners resulting from the progressive pattern of closer spacing between the scores has been found to provide a stringer which can withstand considerably greater force or weight without significant distortion or creasing. The sheet 56 is wound to form a multi-layered tube. The strength enhancement is particularly important when the pallet is supported on a fork lift because the fork seats against the bottom edges of the stringers, and, consequently, the entirety of the load weight is applied to the fork lift through the stringers with no weight being exerted by the lifted load upon the runners.

Although the stringers are illustrated as having an equilateral triangular cross-section, some preliminary tests have shown that an obtuse, isosceles triangular cross-section can offer greater strength. As another alternative, the stringers may be wound around a central core, such as a triangular, preformed, paperboard tube or wooden rod.

A saddle cap, such as saddle cap 29, utilized in embodiments of the invention, is illustrated in FIG. 7. The saddle cap 29 is preferably formed from a sheet 64 of corrugated board, having a central web 66 defined by spaced scores 68 and 70 forming fold lines. The central web 66 extends approximately the entire length of each runner and overlaps each stringer. The sheet 64 is also formed with a plurality of notches 72, which are formed into the distal edges 74 and 76 of the saddle cap legs 78 and 80. The saddle cap notches 72 have a width which is substantially equal to the width of the top of a stringer, that is substantially equal to one side of a stringer of triangular cross-section, and they are spaced to register with the stringers. Although the notches in the saddle cap 29 can be tapered inwardly so that the notches would be widest at the distal edges 74 and 76 and thereby conform to the cross-sectional contour of the stringers, it is preferred that the notches be rectangular to facilitate subsequent folding of the saddle cap legs 78 and 80 down onto the runners.

After the sheet 64 is cut and scored to form the saddle cap 29, an adhesive is applied to the saddle cap sheet. The saddle cap sheet is then oriented above the assembled and bonded stringers and runners and seated upon them. The legs 78 and 80 are then folded around and against the side legs of the runners and held until the adhesive has set. In this manner, the central web 66 of each saddle cap spans distally across the distally opposite edges of the runners and overlaying the stringers.

The saddle caps are preferably formed of B fluted corrugated board and the notches are die cut. It has been found that the use of the saddle cap greatly improves the strength of the pallet and therefore increases the weight which the pallet can support. The saddle caps withstand a tension force to prevent the outward movement of the distal edges of the runner legs, and otherwise lock the stringers in place and lock the entire unit together.

The adhesive materials, or other bonding agents or devices utilized in connection with the present invention, are those conventionally used in the field of constructing corrugated containers and other paper and board technology. Pressure is applied to bonded layers of sheet material.

It is contemplated and preferred that the three separate components, runners, stringers and saddle caps, be individually manufactured along three separate, parallel production lines. At the finished end of these production lines the adhesive is applied to the V notches 50, the stringers are positioned transversely across three aligned, parallel runners and held in position until the adhesive is set. Thereafter, the adhesive is applied to three saddle caps and they are positioned over the three parallel runners and their legs folded down and bonded to the legs of the runners.

Figure 9:
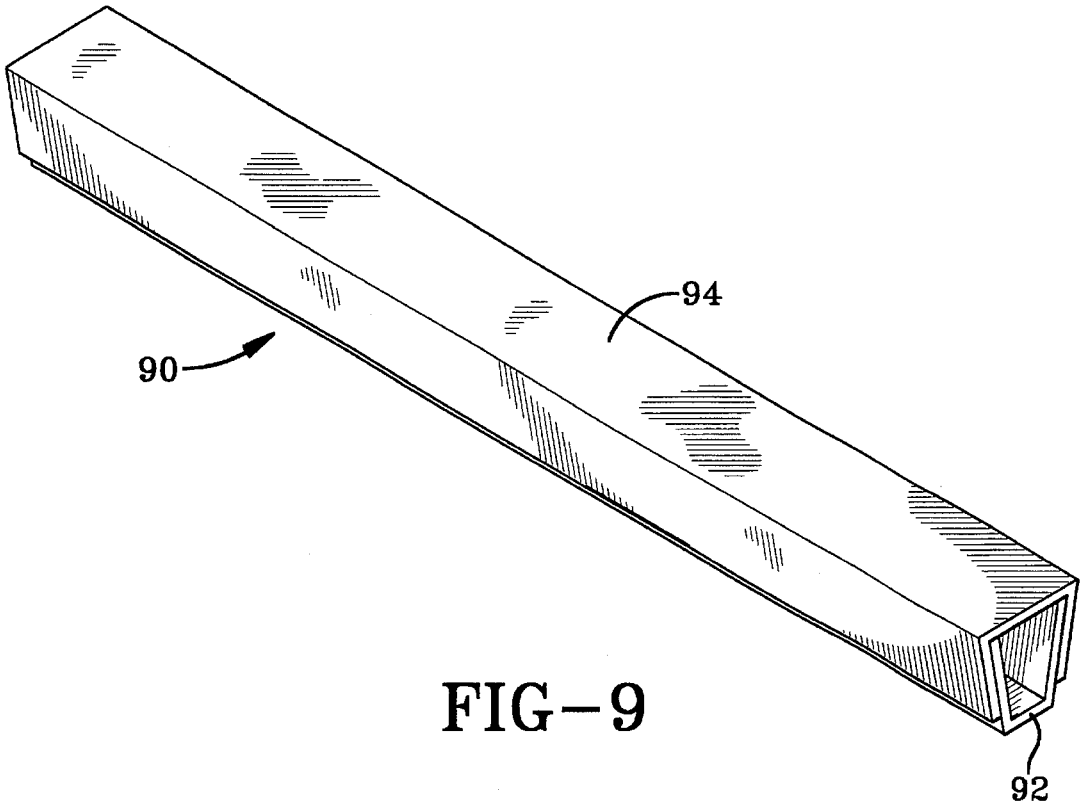
FIG. 9 is a view in perspective of an alternative embodiment of the invention.
Figure 10:
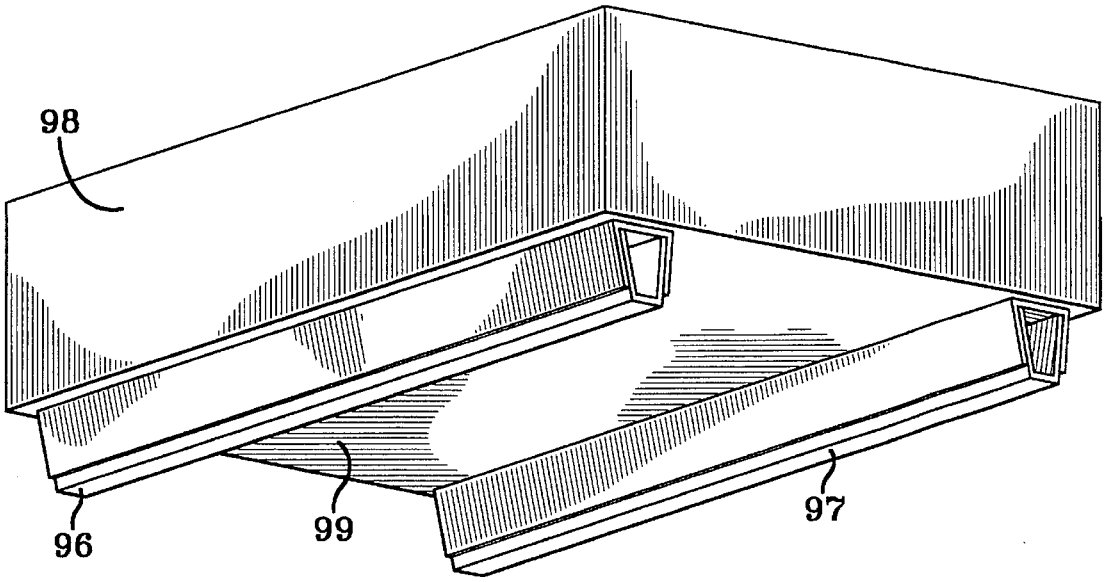
FIG. 10 is a view in perspective of the embodiment of FIG. 9 attached to the bottom of a container.

The runners constructed in accordance with the present invention may also be formed without the notches in the simple configuration illustrated in FIG. 9. FIG. 9 shows a runner 90 having a U-shaped channel 92 and a saddle cap 94, both constructed as described above. Multiple runners may then be bonded by adhesive or otherwise attached to the bottom side of a load bearing support panel to provide a pallet-like structure formed as a unitary body with the support panel. For example, FIG. 10 illustrates a pair of runners 96 and 97 bonded to the underside of a paperboard carton 98. The load bearing support panel is the bottom panel 99 of the carton 98. Alternatively, however, it can be a planar support panel, such as a paperboard or wooden panel, forming an alternative pallet structure utilizing runners embodying the present invention.

While certain preferred embodiments of the present invention have been disclosed in detail, it is to be understood that various modifications may be adopted without departing from the spirit of the invention or scope of the following claims.

We claim:

1. A pallet comprising:

(a) a plurality of generally parallel runners, each runner comprising a plurality of nested, paperboard laminations bonded together to form a U-shaped channel having a central web and legs extending from the central web, the central webs of the laminations being defined by spaced scores which are progressively more closely spaced toward the interior of the runner, each runner having a plurality of stringer-receiving notches spaced along and formed into opposite distal edges of the legs;

(b) a plurality of spaced, generally parallel, paperboard stringers matingly received and attached in said notches and extending transversely between said runners; and (c) a plurality of generally U-shaped saddle caps, each saddle cap having opposite legs extending from a central web, said U-shaped saddle cap legs bonded to the oppositely directed legs of a runner, the central web of the saddle cap extending between and connecting the opposite, distal edges of the legs of the same runner.

2. A pallet in accordance with claim 1 wherein the legs of each runner diverge from the central web of the runner at an obtuse angle with the central web.

3. A pallet in accordance with claim 2 wherein the central web of each of said saddle caps extends approximately the entire length of each runner over each stringers and has a plurality of notches formed into the distal edges of the saddle cap legs, the saddle cap notches having a width substantially equal to the width of the stringers and spaced to register with the stringers.

4. A pallet in accordance with claim 3 wherein each stringer comprises a multilayered coil of paperboard sheet wound into a tube of triangular cross-section, the legs of said triangular cross-section defined by spaced, generally parallel scores, the scores of the more interior layers being more closely spaced than the scores of the more exterior layers and having interfacing legs bonded together and wherein the notches in said runners are triangularly shaped and sized to matingly receive two legs of a stringer.

5. A pallet in accordance with claim 4 wherein the stringer scores are more closely spaced in a sequence wherein the scores define contiguous pairs of equal width legs, the pairs becoming more closely spaced progressively toward the interior of the stringers.

6. A pallet in accordance with claim 5 wherein said saddle caps are formed of corrugated board, the notches of said saddle caps are rectangular and the saddle cap legs are bonded to the exterior surfaces of the runner legs.

7. A pallet in accordance with claim 6 wherein opposite legs of the runner-forming laminations are progressively shorter in sequence with their progressively more closely spaced web defining scores

8. A pallet in accordance with claim 1 wherein opposite legs of the runner forming laminations are progressively shorter in sequence with their progressively more closely spaced web defining scores.

9. A method for constructing a paperboard pallet, the method comprising:

(a) forming a plurality of runners, each runner formed by:

(i) scoring a plurality of paperboard sheets to form fold lines which are interposed between sides of the sheets and progressively more closely spaced to define a central web;

(ii) folding the sheets along the scores, nesting the sheets with the progressively more closely spaced scores nested within more widely spaced scores to form a U-shaped channel having legs extending from the central webs, and bonding the nested sheets together in laminated relationship; and (iii) forming spaced, stringer-receiving notches into the distal opposite side edges of the runner forming sheets;

(b) forming a plurality of stringers, each stringer formed by:

(i) scoring a rectangular sheet of paperboard along a plurality of generally parallel fold lines, scores nearer a first side of the stringer sheet being more closely spaced than scores nearer the opposite second side of the stringer sheet;

(ii) coating a surface of the stringer sheet with an adhesive; and (iii) folding along the scores beginning with the first side of the sheet to wind the stringer sheet into a tube and bonding interfacing layers of the sheet to form a multilayered tube;

(c) positioning and bonding a plurality of said stringers transversely across a plurality of said runners in said notches;

(d) forming a plurality of saddle caps, each saddle cap formed by:

(i) scoring a rectangular sheet along substantially parallel fold lines interposed between the side edges and spaced a distance approximately equal to the distance between the distally opposite edges of the runners to define a central web and opposite side legs;

(ii) forming a plurality of spaced notches into the distal edges of the saddle cap legs, the notches having a width approximately equal to the width of the stringers and a spacing approximately equal to the spacing of the runner notches; and (iii) applying an adhesive to a surface of the saddle cap sheet; and (e) positioning and bonding said saddle caps to said runners with the said saddle cap central web spanning the distally opposite edges of the runners and overlaying the stringers and folding the side legs of the saddle cap against the legs of the runners.

10. A method in accordance with claim 9 wherein the legs of the U-shaped runners are folded to and bonded at an obtuse angle with the central web of the runner so they diverge from the web.

11. A method in accordance with claim 10 wherein the stringer sheet is wound into a tube having an equilateral, triangular cross-section.

12. A load supporting runner for attachment to the underside of a load bearing support panel, the runner comprising:

(a) a plurality of nested, paperboard laminations bonded together to form a U-shaped channel having a central web and legs extending from the central web, the laminations having a central web and legs extending from the central web, the central webs of the laminations being defined by spaced scores which are progressively more closely spaced toward the interior of the channel, and each leg having an opposite edge spaced distally from the central web; and (b) a generally U-shaped saddle cap having opposite legs extending from a central web, said saddle cap legs bonded to the oppositely directed legs of the channel, the central web of the saddle cap extending between and connecting the opposite, distal edges of the legs of the channel.

13. A pallet in accordance with claim 12 wherein the legs of the channel diverge from the central web of the channel at an obtuse angle with the central web.

14. A pallet in accordance with claim 13 wherein opposite legs of the channel-forming laminations are progressively shorter in sequence with their progressively more closely spaced web defining scores.

* * * * *